US005220816A

United States Patent [19]

Fish et al.

[11] Patent Number: 5,220,816

[45] Date of Patent: Jun. 22, 1993

[54] SECURITY ARRANGEMENT FOR PUSH BUTTON LOCK

[75] Inventors: Aaron M. Fish, Hampstead; Gino Mancini, St. Leonard, both of Canada

[73] Assignee: Ilco Unican Inc., Montreal, Canada

[21] Appl. No.: 814,830

[22] Filed: Dec. 31, 1991

[51] Int. Cl.[5] ..... E05B 13/10

[52] U.S. Cl. ..... 70/214; 70/466; 70/451

[58] Field of Search ..... 70/DIG. 57, 370, 371, 70/451, 466, 214, 232; 292/357, 351

[56] References Cited

U.S. PATENT DOCUMENTS

| | | | |
|---|---|---|---|
| 1,092,733 | 4/1914 | McCarthy | 70/214 |
| 3,760,619 | 9/1973 | Colombo | 70/DIG. 57 |
| 3,768,284 | 10/1973 | Kent et al. | 70/104 |
| 4,453,389 | 6/1984 | Kaufman | 70/416 |
| 4,484,463 | 11/1984 | Hennessy | 70/452 |
| 4,522,048 | 6/1985 | Davis | 70/417 |
| 4,548,062 | 10/1985 | Kaufman | 70/417 |
| 4,688,409 | 8/1987 | Oliver et al. | 70/451 |
| 4,712,403 | 12/1987 | Markisello | 70/451 |
| 4,813,250 | 3/1989 | Yeh | 70/DIG. 57 |
| 5,083,122 | 1/1992 | Clark | 70/278 |
| 5,118,152 | 6/1992 | Lin | 292/357 |

*Primary Examiner*—Peter M. Cuomo
*Assistant Examiner*—Darnell M. Boucher
*Attorney, Agent, or Firm*—Jacobson, Price, Holman & Stern

[57] ABSTRACT

The security arrangement prevents unauthorized removal of the push button lock arrangement from a door on which it is installed. The door has an inner surface and an outer surface and the push button lock arrangement includes a first housing for mounting on the inner surface and a second housing for mounting on the outer surface. A first cover plate is removably mounted on the first housing adjacent the inner surface of the door, and a second cover plate is mounted on the second housing adjacent the outer surface of the door. The security arrangement consists of co-operating elements mounted on the first cover plate and the second cover plate.

9 Claims, 3 Drawing Sheets

SECURITY ARRANGEMENT FOR PUSH BUTTON LOCK

BACKGROUND OF INVENTION

1. Field of the Invention

The invention relates to a security arrangement for preventing the unauthorized removal of a lock from the door on which the lock is installed. More specifically, the invention relates to such a security arrangement for use in association with a push button lock arrangement.

2. Description of Prior Art

It is well known that individuals, attempting to make an unauthorized entry through a door which is kept locked by a lock, if they cannot defeat the lock, will attempt to remove the lock to thereby gain entry. It therefore becomes necessary to secure the lock to the door to prevent its unauthorized removal.

Arrangements for preventing the unauthorized removal of cylinder locks are taught in, for example, U.S. Pat. No. 4,484,463, Hennessy, Nov. 27, 1984, U.S. Pat. No. 4,522,048, Davis, Jun. 11, 1985, U.S. Pat. No. 4,453,389, Kaufman, Jun. 12, 1984, U.S. Pat. No. 4,548,062, Kaufman, Oct. 22, 1985, and U.S. Pat. No. 4,712,403, Markisello, Dec. 15, 1987.

In the U.S. Pat. No. '463 patent, a plate 12 is mounted on the outside of a door 32 such that aperture 20 overlies cylinder 34. Bolts 42, having heads 44 whose shape corresponds with the shape of the apertures 22 in the plate, secure the plate to the door. Thus, the plate can be removed only from the inside by rotation of the female sleeve nuts 50.

In the U.S. Pat. No. '048 patent, a plate 12 is mounted on the outside of the door and a plate 46 is provided on the inside of the door to protect cylinder lock 36 from unauthorized removal. The plate 12 is welded to the tube 16 through which lock 36 passes. The tube 16 and lock 36 extend through bore 34 in door 48. Bolts 54 extend through plate 12, bores 52 (in door 48) and plate 46 and are secured by lock nuts 58 on the inside of the door.

A movable, pivoting plate or blind 6 is provided, in accordance with the teachings of the U.S. Pat. No. '389 patent, to protect against unauthorized entry. As seen in FIG. 2 of the patent, plate 6 is urged against connecting bar (tailpiece) 8 by spring 7. If the cylinder is removed, then plate 6 will assume the position shown in dotted lines in FIG. 2 so that a screwdriver cannot be inserted in the slot to unlock the lock. Thus, this arrangement does not prevent removal of the lock, but prevents the lock from being unlocked after the cylinder has been removed. Nevertheless, it is of interest in that it teaches the use of a plate 6 for preventing unauthorized entry.

In the U.S. Pat. No. '062 patent, a plate 1 is mounted over lock 2 on the inside of the door to prevent the lock from being pushed in from the outside. Plate 9 may be mounted on the outside of the door to cover the heads of bolts 4 which fasten plate 1 to the door (see FIG. 3).

Plate 3, in the U.S. Pat. No. '403 patent, includes an opening having a large hole 2 and a smaller hole underlying the hole 2 (see FIG. 6). As seen in FIGS. 1 to 4, the cylinder is slid into the large hole and the plate is then moved up (or the cylinder moved down) so that the arrangement is securely held in the plate. The arrangement is then mounted on a door as shown in FIG. 4 of the patent.

In all of the above arrangements, authorized removal of the lock is possible when the lock is either in its locked or unlocked condition.

Also known in the art are arrangements for securing push button lock arrangements to the doors on which they are installed. To Applicant's knowledge, all such arrangements permit authorized removal of the lock from the door even when the correct combination has not been punched in.

SUMMARY OF INVENTION

It is an object of the invention to provide a security arrangement for preventing unauthorized removal of a push button lock arrangement from a door on which it is installed.

It is a further object of the invention to provide such a security arrangement for a push button lock arrangement having an inside the door housing and an outside the door housing, each housing having a cover plate, the security arrangement comprising cooperating elements on each said plate.

It is a still further object of the invention to provide such an arrangement including movable means movable along one of said cover plates, and means extending from said other cover plate through said door toward said one of said cover plates for engaging said movable means in a locked in condition in one position of said movable means and in a released condition in a second position of said movable means, said movable means being movable only upon actuation of the correct combination of said push button lock arrangement.

In accordance with the invention there is provided a security arrangement for preventing unauthorized removal of a push button lock arrangement from a door on which it is installed, said door having an inner surface and an outer surface, said push button lock arrangement including a first housing for mounting on said inner surface and a second housing for mounting on said outer surface, a first cover plate removably mountable on said first housing adjacent said inner surface and a second cover plate on said second housing adjacent said outer surface;

said security arrangement comprising cooperating elements on said first cover plate and said second cover plate.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
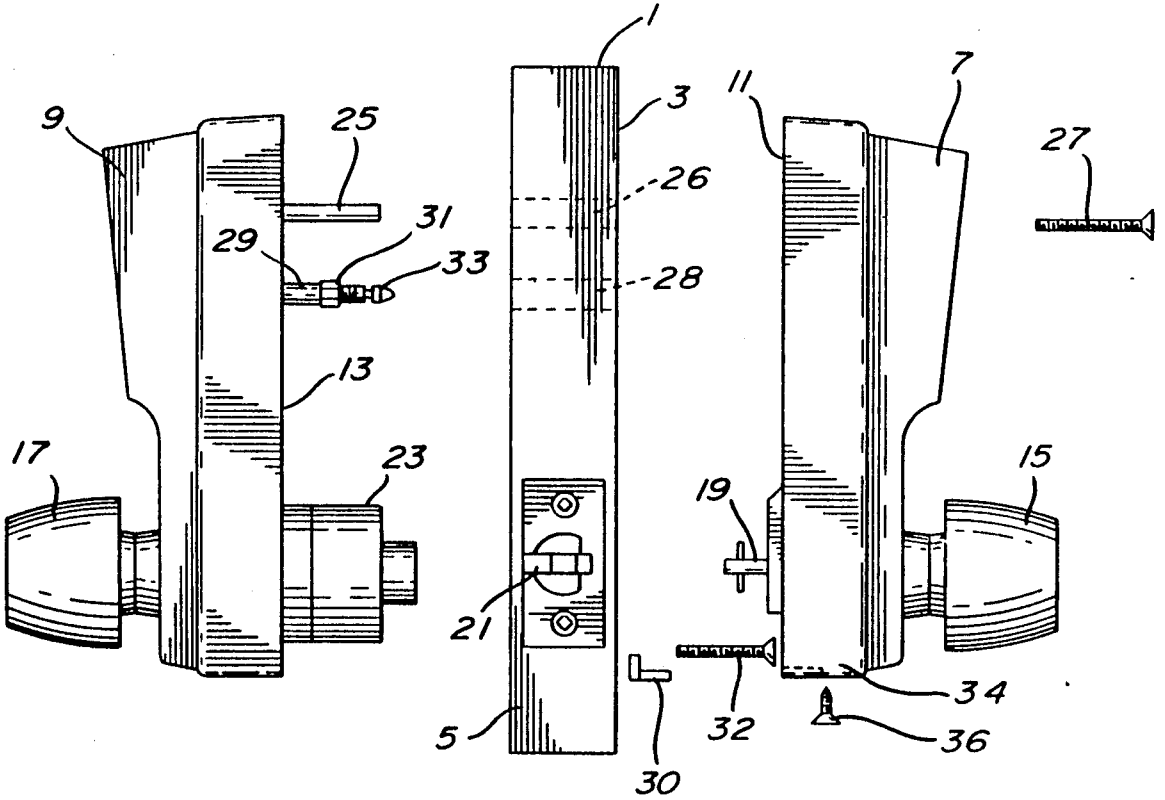
FIG. 1 is a schematic illustration of the security arrangement in accordance with the invention.

Referring to FIG. 1, the security arrangement in accordance with the invention is contemplated to be mounted on a door 1 having an inner surface 3 and an outer surface 5. Mounted on the inner surface is an inside housing 7, and mounted on the outer surface is an outside housing 9. As is well known, the combination chamber is mounted in the outside housing 9 and the push buttons are located on this housing.

Figure 2:
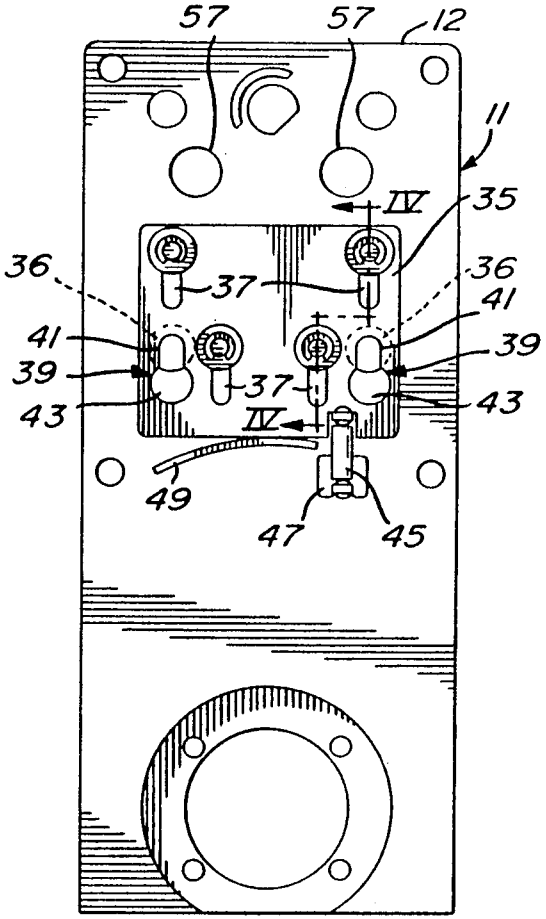
FIG. 2 illustrates the surface of the cover plate of the inside housing facing the inside of the housing and the sliding plate mounted thereon.
Figure 5:
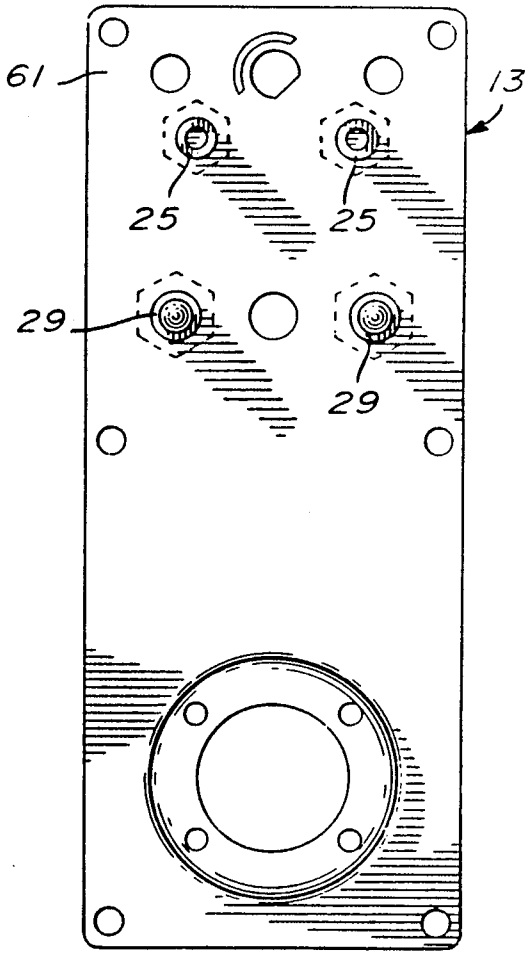
FIG. 5 illustrates the outside surface of the cover plate of the outside housing.
Figure 3:
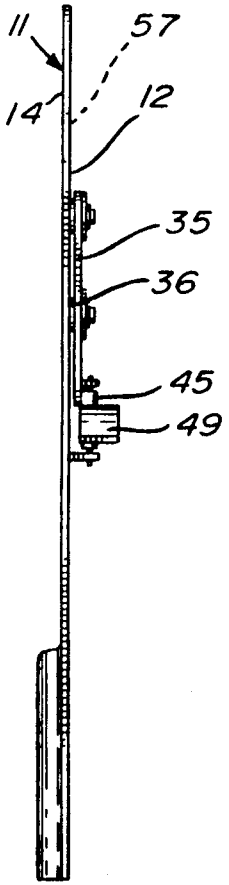
FIG. 3 is a side view of FIG. 2.
Figure 6:
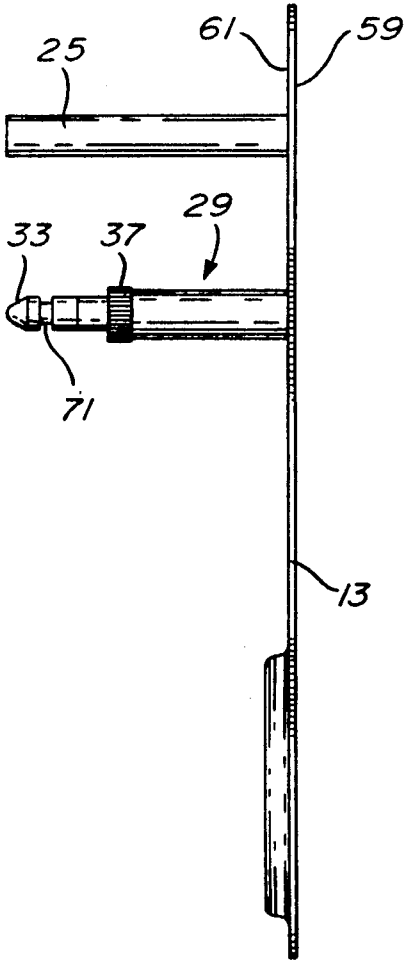
FIG. 6 is a side view of FIG. 5.

The housing 7 is covered with a housing plate which, as seen in FIGS. 2 and 3, has a surface 12 facing the inside of the housing and surface 14 disposed adjacent the surface 3 of the door. A cover plate 13 is mounted on the outside housing 9. As seen in FIGS. 5 and 6, the cover plate 13 includes a surface 59 facing the inside of the housing and a surface 61 adjacent the surface 5 of the door.

Housing 7 includes an inside handle 15 and housing 9 includes an outside handle 17. Drive shaft 19, which extends into the door, is adapted to retract latch 21. Drive arrangement 23 will also retract latch 21 when the correct combination has been punched in.

Sleeves 25 (of which there are two as can be seen in FIG. 5) extend into opening 26 in the door. Anti-tamper screws 27 (of which there are also two) extend through the housing 7 into the sleeves 25 which have an internal thread. The anti-tamper screws are then screwed into the sleeves so that the housings 7 and 9 are held tightly against the door 1. Locking posts 29 (of which there are two as also seen in FIG. 5) including an adjusting nut 31 and a screw stud 33 extend through openings 28 for purposes which will be discussed below.

Angle bracket 30, which has a width equal to the width of the housing 7, is screwed to the door 1 by Philip screws 32. The horizontal leg of the angle bracket slides into an opening 34 at the bottom of the housing 7, and anti-tamper screw (or screws) 36 will be screwed into screw holes of the leg of the angle bracket 30 (not shown in the drawings).

As seen in FIGS. 2 and 3, a sliding plate 35 is mounted on the surface 12 of the cover plate 11 facing the inside of the surface 12. The sliding plate is somewhat rectangular in shape and has a plurality of slots 37. The sliding plate also includes two special openings 39 each of which has a lock-in portion 41 and a release portion 43. As can be seen in FIG. 2, the lock-in portion 41 is of smaller diameter than the diameter of the release portion 43.

Disposed at the bottom of the sliding plate 35 is a return spring 45 mounted on a spring holder 47. Engagement member 49 is attached to the bottom of the sliding plate. The engagement member is arcuate in shape.

Figure 4:
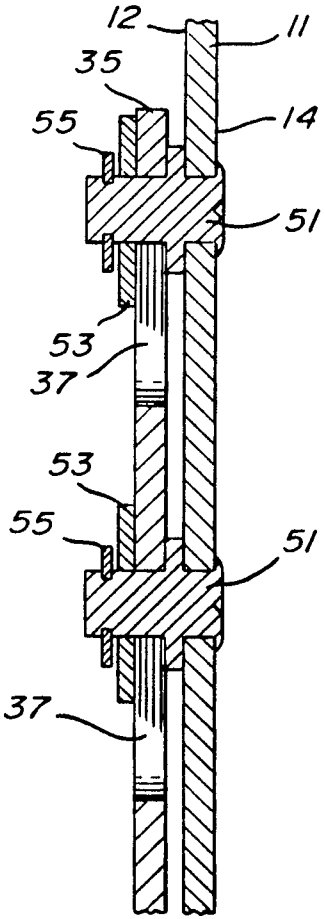
FIG. 4, is a section through IV—IV of FIG. 2 and illustrates details of FIG. 2.

As seen in FIG. 4, a plurality of posts 51 are staked onto the cover plate 11 and extend through respective ones of the slots 37. As the diameter of the posts 51 is somewhat less than the width of the slots 37, the sliding plate can slide upwardly and downwardly over the posts and parallel to the direction of the cover plate 11. Washers 53 and C-clips 55 are mounted on the posts on the other side of the sliding plate so that the sliding plate 35 does not fall off the posts 51.

The cover plate 11 also includes two openings 57 (see FIG. 2), and the sleeves 25, after passing through openings 26 in the door 3, enter into the housing 7 through the openings 57. The front of the housing 7 will include two openings for receiving anti-tamper screws 27 which are then screwed into the threaded interiors of respective ones of the sleeves 25.

Openings 36 (see FIG. 2) in cover plate 11, disposed adjacent respective ones of special openings 39, permit locking posts 29 to pass through the cover plate 11 and into the special openings 39.

Turning now to FIGS. 5 and 6, it can be seen that the cover plate 13 of the housing 9 has a surface 59, facing the inside of the housing, and a surface 61, disposed adjacent to the door 3. It can also be seen that the locking post 29 has a circumferential slot defining a slotted portion 71. The diameter of the slotted portion 71 is less than the diameter of the lock-in portion 41 of the special opening 39. The diameter of the screw stud is greater than the diameter of the lock-in portion 41 but less than the diameter of the release portion 43.

When the edge of the lock-in portion 41 is in a respective slot 71, the sliding plate 35 is held fast by the lock-in post 29 so that the sliding plate 35 is effectively connected to the cover plate 13 to thereby prevent the removal from the door of cover plate 11. When the lock-in post 29 is in the release portion 43, then it is possible to move the sliding plate 35 off the post 29 to thereby remove the lock.

Figure 8:
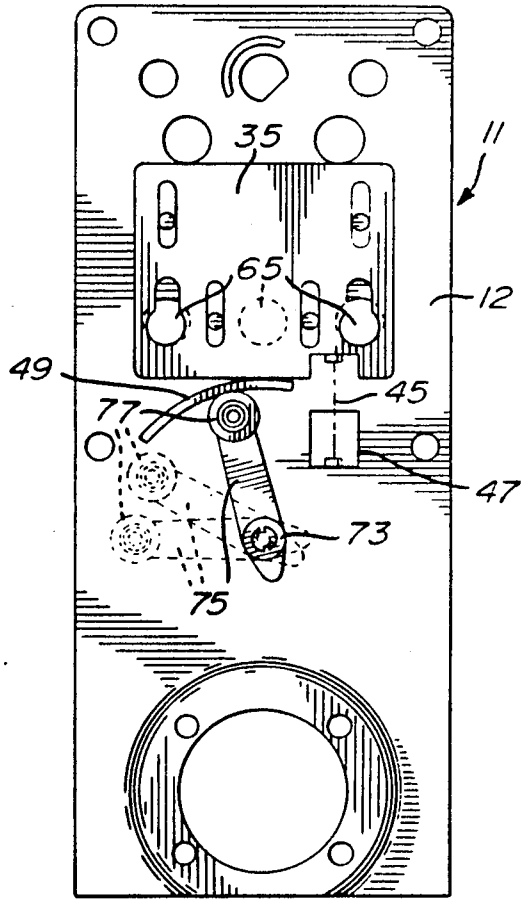
FIG. 8 illustrates the sliding plate in its release position.
Figure 7:
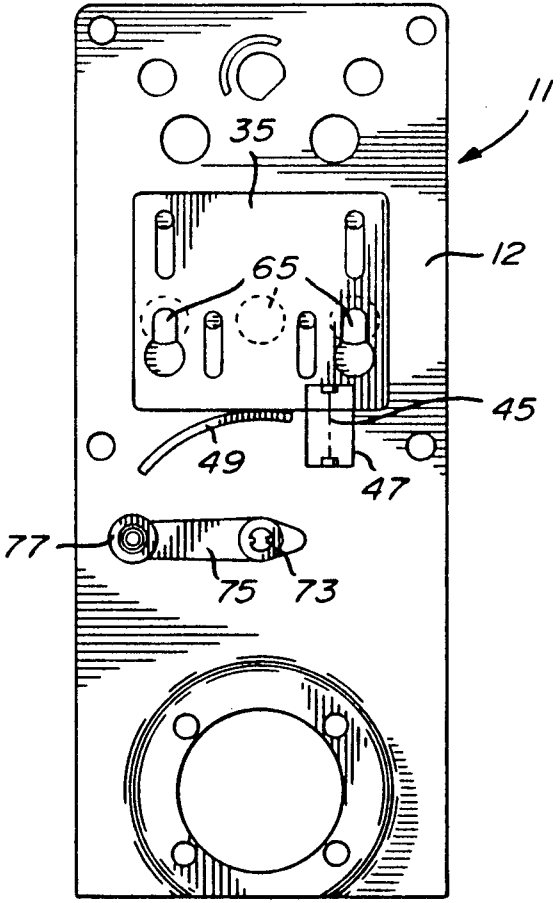
FIG. 7 illustrates the sliding plate in its lock-out position.

Turning now to FIGS. 7 and 8, it can be seen that, mounted on the surface 12 of the cover plate 11 is a rotating member 73. The rotating member is connected to the connecting link of the push button lock for rotation therewith. As is known, the connecting link will rotate only after the correct combination of the combination chamber has been punched in.

Attached to the rotating member is a lever 75 which pivots with the rotational motion of the rotating member 73. Attached at the free end of the lever is a camming member 77.

The security arrangement, as shown in FIG. 7, is in its lock-out position, i.e., the sliding plate 35 is effectively connected to the cover plate 13 so that plate 11 cannot be removed from the door 3. When the correct combination is punched into the push button chamber, and the connecting link is rotated, then rotating member 73 will also rotate and pivot with it the lever 75 as shown in FIG. 8. With this action, camming member 77 will engage the engagement member 49 to push it, and the sliding plate 35, upwardly to the position shown in FIG. 8. At this time, the sliding plate can be moved off the locking post so that, in the absence of any other connections, the cover plate 11, and its housing 7, can be removed from the door. Thus, it can be seen that it is possible to remove the lock only after the correct combination has been punched into the combination chamber.

When the connecting link is released and rotated in a counter-clockwise direction to return to its position in FIG. 7, spring 45 will pull sliding plate 35 downward so that it returns to its position as shown in FIG. 7.

In operation, to mount the lock on a door, the correct combination is punched in the push button chamber and the sliding plate 35 is lifted to its upward position so that lock-in posts 31 extend through the release openings 43 of the special opening 39. The lever 75 is then rotated in a counter-clockwise direction so that the spring 45 will pull the plate downwardly so that the edge of lock-in portion 41 of the special opening 39 is in the slot 71 of the lock-in post 31. The lock is then secured to the door and cannot be removed until the proper combination is punched into the combination chamber.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A security arrangement for preventing unauthorized removal of a push button lock arrangement from a door on which it is installed, said door having an inner surface and an outer surface, said push button lock arrangement including a first housing for mounting on said inner surface and a second housing for mounting on said outer surface, a first coverplate removably mountable on said first housing adjacent said inner surface and a second cover plate on said second housing adjacent said outer surface;

said first cover plate having a first surface facing the inside of said first housing and a second surface for mounting adjacent said inner surface of said door;

said security arrangement comprising:

a sliding plate being mounted on said first surface of said first cover plate for sliding relative to said first cover plate;

engagement means extending from the other one of said cover plates through said door toward the other one of said cover plates;

said engagement means engaging said sliding plate in a locked-in condition in one position of said sliding plate whereby to prevent the removal of said push button lock arrangement from said door;

said engagement means engaging said sliding plate in a release condition when said sliding plate is in a second position;

said sliding plate being movable from said first position to said second position only upon actuation of the opening combination of said push button lock arrangement;

whereby said push button lock arrangement can be removed from said door only upon actuation of said open combination.

2. A security arrangement as defined in claim 1 and including four posts staked to said first surface of said first cover plate and extending inwardly thereof;

said sliding plate comprising four slots, a respective one of said posts extending through a respective one of said slots when said sliding plate is mounted on said cover plate;

whereby, said sliding plate is slidable over said posts in a direction parallel to the direction of said first cover plate.

3. A security arrangement as defined in claim 2 wherein said second cover plate comprises a first surface facing inside of said first housing and a second surface for mounting adjacent said outer surface of said door;

at least one post extending from said second surface of said second cover plate and outwardly therefrom;

said sliding plate comprising at least one special opening for receiving said at least one post;

said at least one post extending through said door, through said first cover plate, and into said special opening.

4. A security arrangement as defined in claim 3 wherein said special opening has a lock-in portion and a release portion, said lock-in portion having a diameter smaller than the diameter of said release portion;

said at least one post having a slotted portion having a diameter smaller than the diameter of said lock-in portion and a stud portion larger than the diameter of said lock-in portion but smaller than the diameter of said release portion;

said security arrangement being in a lock-in position when said slotted portion of said at least one post is in the lock-in portion of said special opening.

5. A security arrangement as defined in claim 4 wherein said at least one lock-in post is adjustable in length.

6. A security arrangement as defined in claim 5 comprising two lock-in posts and two mating special openings.

7. A security arrangement as defined in claim 6 wherein said sliding plate has an engagement member disposed on one edge thereof.

8. A security arrangement as defined in claim 7 and including a lever means connected to a rotating member which is connected to the connecting link of said push button lock arrangement;

said lever having a camming member at the free end thereof for engagement with said engagement member to slide said sliding plate from its lock-in position to a release position.

9. A security arrangement as defined in claim 8 and including spring means connected to said sliding plate for returning said sliding plate from its lock-in position to its release position.

* * * * *